US010821453B2

(12) United States Patent
Armbruster et al.

(10) Patent No.: US 10,821,453 B2
(45) Date of Patent: Nov. 3, 2020

(54) SHOWER JET GENERATING DEVICE

(71) Applicant: Hansgrohe SE, Schiltach (DE)

(72) Inventors: Jochen Armbruster, Wolfach (DE); Sebastian Steiert, Villingen-Schwenningen (DE); Joachim Dieterle, Lossburg/Schomberg (DE)

(73) Assignee: Hansgrohe SE, Schiltach (DE)

( * ) Notice: Subject to any disclaimer, the term of this patent is extended or adjusted under 35 U.S.C. 154(b) by 0 days.

(21) Appl. No.: 15/722,411

(22) Filed: Oct. 2, 2017

(65) Prior Publication Data

US 2018/0099295 A1 Apr. 12, 2018

(30) Foreign Application Priority Data

Oct. 7, 2016 (DE) ..... 10 2016 219 551

(51) Int. Cl.
*B05B 1/32* (2006.01)
*B05B 15/528* (2018.01)
(Continued)

(52) U.S. Cl.
CPC ..... *B05B 1/323* (2013.01); *B05B 1/185* (2013.01); *B05B 1/3006* (2013.01); *B05B 15/528* (2018.02)

(58) Field of Classification Search
CPC . E03C 1/08; E03C 1/084; E03C 1/086; B05B 1/323; B05B 1/185; B05B 1/3006;
(Continued)

(56) References Cited

U.S. PATENT DOCUMENTS 1,236,617 A * 8/1917 Speakman ..... B05B 15/5225 239/118
2,402,741 A 6/1946 Draviner
(Continued)

FOREIGN PATENT DOCUMENTS

CN 203108678 U 8/2013
DE 2215344 B1 8/1973
(Continued)

OTHER PUBLICATIONS

Search Report issued by the European Patent Office, dated Feb. 7, 2018, for related Application No. EP17194704; 7 pages.
(Continued)

*Primary Examiner* — Viet Le
*Assistant Examiner* — Christopher R Dandridge
(74) *Attorney, Agent, or Firm* — Faegre Drinker Biddle & Reath LLP

(57) ABSTRACT

A shower jet generating device for a sanitary shower head has a jet disk that delimits a fluid chamber on the outlet side and has at least one jet disk opening. A fluid outlet element is disposed on the at least one jet disk opening and is movable in an axial main direction component, which element includes a movable valve body having a fluid outlet opening issuing from the fluid chamber. The fluid outlet opening is unblocked in an unblocking position of the fluid outlet element and is blocked in a blocking position of the fluid outlet element in response to a fluid pressure in the fluid chamber. The movable valve body cooperates with an unmovable valve seat which unblocks the fluid outlet opening in the unblocking position of the fluid outlet element and blocks it in a blocking position of the fluid outlet element.

13 Claims, 6 Drawing Sheets

Figure 1:
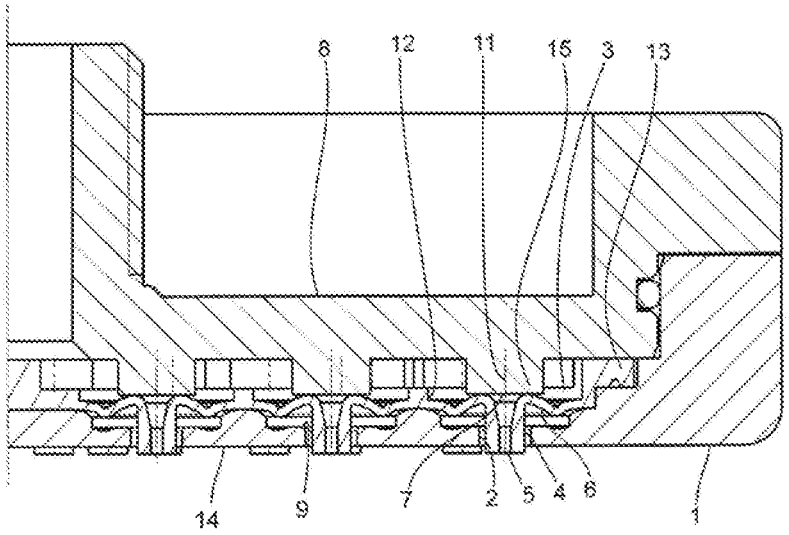

(51) Int. Cl.
*B05B 1/18* (2006.01)
*B05B 1/30* (2006.01)

(58) Field of Classification Search
CPC .... B05B 1/18; B05B 1/32; B05B 1/30; B05B 1/52; B05B 1/525; B05B 1/528; B05B 15/528; B05B 15/5225; B05B 15/74; F16K 15/144; F16K 15/145
USPC ..... 137/859
See application file for complete search history.

(56) References Cited

U.S. PATENT DOCUMENTS

| | | | | |
|---|---|---|---|---|
| 3,734,410 | A | 5/1973 | Bruno | |
| 3,830,432 | A | 8/1974 | Grohe | |
| 5,228,625 | A | 7/1993 | Grassberger | |
| 5,246,301 | A | 9/1993 | Hirasawa | |
| 6,209,799 | B1 | 4/2001 | Finkbeiner | |
| 6,378,790 | B1 * | 4/2002 | Paterson | B05B 1/08 137/853 |
| 6,382,531 | B1 * | 5/2002 | Tracy | B05B 1/185 239/548 |
| 7,040,554 | B2 * | 5/2006 | Drennow | B05B 1/14 239/331 |
| 8,985,483 | B2 * | 3/2015 | Petrovic | B05B 1/18 239/396 |
| 9,839,923 | B2 * | 12/2017 | Ramos De Barros | B05B 1/185 |
| 2003/0038189 | A1 | 2/2003 | Titinet | |
| 2003/0062426 | A1 * | 4/2003 | Gregory | B05B 1/185 239/107 |
| 2011/0101132 | A1 | 5/2011 | Nordstrom | |
| 2012/0103186 | A1 | 5/2012 | Pierquin et al. | |
| 2014/0014743 | A1 | 1/2014 | Schorn et al. | |
| 2016/0332173 | A1 | 11/2016 | Butzke et al. | |
| 2018/0178225 | A1 | 6/2018 | Butzke et al. | |

FOREIGN PATENT DOCUMENTS

| | | | | |
|---|---|---|---|---|
| DE | 10 2006 032 017 | B3 | 1/2008 | |
| DE | 10 2014 200 741 | A1 | 7/2015 | |
| EP | 0894536 | A2 | 2/1999 | |
| EP | 1700636 | * | 9/2006 | B05B 1/185 |
| EP | 1700636 | A2 | 9/2006 | |
| EP | 2 684 610 | A1 | 1/2014 | |
| RU | 2534086 | A | 11/2014 | |
| WO | 95/22407 | A1 | 8/1995 | |
| WO | 2009126987 | A1 | 10/2009 | |
| WO | 2014029636 | A2 | 2/2014 | |
| WO | 2014029639 | A2 | 2/2014 | |
| WO | WO2014029636 | * | 2/2014 | B05B 1/185 |

OTHER PUBLICATIONS

English translation of Office Action in Chinese Application No. 201710913672.5, dated Mar. 14, 2019, and corresponding Office Action in Chinese language, issued by the State Intellectual Property Office of the People's Republic of China.

* cited by examiner

SHOWER JET GENERATING DEVICE

The invention relates to a shower jet generating device with a shower jet disk, including at least one jet disk opening and delimiting a fluid chamber on the outlet side, and a fluid outlet element disposed on the at least one jet disk opening and movable in an axial main direction component, which element includes a movable valve body having a fluid outlet opening issuing from the fluid chamber, which fluid outlet opening is unblocked in an unblocking position of the fluid outlet element and is blocked in a blocking position of the fluid outlet element in response to a fluid pressure in the fluid chamber.

An axial main direction component of the movement of the fluid outlet element is to be understood here as meaning that the component of this movement in an axial direction is greater than perpendicularly thereto. The axial direction of the movable fluid outlet element can in particular be parallel to a longitudinal axis of the fluid outlet opening and/or to a jet direction of a fluid emerging from its fluid outlet opening and/or an axial direction of the shower jet disk. The fluid pressure prevailing in the fluid chamber during the intended use of the shower jet generating device ensures that the movable valve body adopts its unblocking position and the fluid outlet opening is unblocked, whereas the valve body, in the pressureless state of the fluid chamber, adopts its blocking position and the fluid outlet opening is blocked. Such an arrangement makes it possible, after the supply of water has been blocked, to counteract undesired dripping from a shower that is equipped accordingly.

The shower jet generating device can be used in particular for a sanitary shower head to which a fluid, e.g. water, can be supplied via an admission line, which fluid then passes into the fluid chamber and from there into the one or more fluid outlet openings, from which it emerges to form a shower jet. Such devices for generating a shower jet are used in particular in sanitary shower heads, e.g. hand-held shower attachments, overhead shower attachments and side shower attachments of showering installations.

Laid-open application EP 1 700 636 A2 discloses a shower head with a shower jet generating device of the type mentioned at the outset, in which each jet disk opening is assigned a valve element in the form of a curved membrane portion which has at least one incision and can be moved axially and bent open by water pressure acting on it, as a result of which a water outlet opening is provided that is closed in the pressureless state.

It is an object of the invention to make available a shower jet generating device of the type mentioned at the outset which is improved in relation to the prior art discussed above and which in particular reliably prevents undesired dripping, is relatively easy to produce and is operationally reliable, and in which the fluid outlet opening has an outlet cross section that is largely uninfluenced by the fluid pressure in the fluid chamber.

These and other objects are achieved by the invention as disclosed and claimed, including advantageous and preferred configurations of the invention presented as examples and/or defined in the claims, the wording of which is hereby included in full in the description by way of reference.

In the shower jet generating device according to the invention, which can be used in particular for a sanitary shower head, the movable valve body cooperates with an unmovable valve seat which unblocks the fluid outlet opening in the unblocking position of the fluid outlet element and blocks it in a blocking position of the fluid outlet element. The shower jet generating device according to the invention can reliably prevent undesired dripping and is relatively easy to produce and operationally reliable. Furthermore, the outlet cross section of the fluid outlet opening is largely uninfluenced by the fluid pressure in the fluid chamber.

The jet disk can be designed in one piece or can be composed of a plurality of component parts which may be made of different materials, in particular an elastic material and/or a plastic and/or a metal. It is thus possible, for example, for the jet disk to have a rubber plate or rubber mat and a metal disk and/or hard plastic disk which have corresponding jet disk openings, wherein the rubber plate or rubber mat is placed, from the inside of the fluid chamber, onto the metal or hard plastic disk such that the corresponding jet disk openings of the rubber plate or rubber mat and of the metal and/or hard plastic disk are oriented towards each other. The possible material combinations of rubber plate or rubber mat and of the metal and/or hard plastic disk are advantageous in respect of increased design freedom, particularly in the design of the shower jet generating device. The jet disk opening can be designed, for example, as a countersunk bore. The geometry of the countersink of the countersunk bore can contribute to receiving and/or supporting and/or enclosing the fluid outlet element arranged in the jet disk opening.

The blocking of the fluid outlet opening, which is preferably designed as a circumferentially closed opening, can in particular be effected, by the unmovable valve seat, by means of the movable valve body lying with its fluid outlet opening against said valve seat in the blocking position. By contrast, in the unblocking position of the valve body, the fluid outlet opening can be spaced apart from the unmovable valve seat and thus unblocked. In corresponding embodiments of the invention, the fluid outlet element or its valve body is designed to adopt the unblocking position as soon as the fluid pressure in the fluid chamber is greater than a previously fixed limit pressure. The previously fixed limit pressure can be, for example, between 0.2 bar and 0.35 bar, in particular between 0.24 bar and 0.26 bar. The fluid outlet opening remains blocked as long as the limit pressure is not reached.

Provision can advantageously be made that the fluid outlet element or the movable valve body is elastically prestressed, e.g. by suitable shaping, in the direction of the blocking position and is pressed from the latter into the unblocking position by the fluid pressure in the fluid chamber. When the fluid pressure in the fluid chamber drops, e.g. below the stated limit pressure, the fluid outlet element or the movable valve body returns automatically to the blocking position.

In one embodiment of the invention, the fluid chamber is delimited, on a side lying opposite the jet disk, by a partition plate or housing plate that includes the unmovable valve seat. In this way, it is possible to reduce the number of component parts. Alternatively, the unmovable valve seat can be secured as an independent component part on the partition plate or the housing plate. The partition plate or the housing plate may perform additional functions if necessary. For example, they can serve as a mounting plate for a one-piece or multi-part jet disk.

In one embodiment of the invention, the movable valve body abuts on a valve abutment surface of the jet disk in the unblocking position. The valve abutment surface of the jet disk makes it possible to limit the movement of the movable valve body. For example, it is possible that the unblocking position of the fluid outlet element is predefined by the valve abutment surface.

In one embodiment of the invention, the fluid outlet element, with its fluid outlet opening in the unblocking position and/or in the blocking position, extends through the jet disk opening. In this way, for example, the removal of lime deposits can be facilitated. Preferably, the fluid outlet opening and/or the movable valve body are made of an elastomer, in particular of a silicone with a Shore hardness of between fifty and seventy. If lime deposits narrow or even obstruct the fluid outlet opening, they can be removed, in a manner known per se, by the user exerting a force by rubbing or the like, which force deforms the fluid outlet opening, as a result of which the lime deposits are caused to break away.

In one embodiment of the invention, the valve seat has a valve seat projection which protrudes into the fluid outlet opening when the fluid outlet opening is blocked. By means of the valve seat projection protruding into the fluid outlet opening, it is possible, for example, to counteract the development of lime deposits, since possible lime deposits are detached by the protruding valve seat projection as the fluid outlet element moves between the blocking position and the unblocking position. Furthermore, the protruding valve seat projection can be advantageous for the interaction of the movable valve body with the unmovable valve seat, in particular for the leaktight blocking of the fluid outlet opening. This is preferably supported by a corresponding negative shape of the valve seat projection or of the unmovable valve seat in respect of the shape of the fluid outlet opening or of the movable valve body.

In one embodiment of the invention, the fluid outlet opening has a dimensionally stable and/or circular cylindrical and/or conical geometry independent of fluid pressure. A dimensionally stable geometry of the fluid outlet opening, i.e. a geometry largely independent of the fluid pressures arising during operation, ensures that, for example, during the intended use of the shower jet generating device, the characteristic of a generated shower jet is to a very great extent independent of the fluid pressure in the fluid chamber. This is because the fluid outlet opening then at all times has a substantially constant cross-sectional surface area and cross-sectional shape.

In one embodiment of the invention, the fluid outlet opening is provided by an outlet nozzle with a nozzle longitudinal axis extending in parallel to a local surface normal of an exterior side of the jet disk. In the case of rotationally symmetrical fluid outlet openings, the nozzle longitudinal axis can be, for example, the rotation axis of the fluid outlet opening.

In one embodiment of the invention, the fluid outlet element has an elastomeric ring membrane surrounding and supporting the movable valve body. The elastomeric ring membrane lies, for example, on the jet disk such that the fluid outlet element is arranged in the associated jet disk opening. The elastomeric ring membrane can make it easier to place the fluid outlet element in the jet disk opening.

In one embodiment of the invention, the fluid outlet element has a one-piece design. This permits simplification and cost reduction, for example in the manufacture of the fluid outlet element and/or the assembly of the shower jet generating device.

In one embodiment of the invention, the jet disk has a plurality of jet disk openings and associated fluid outlet elements. Furthermore, the jet disk has a one-piece elastomeric plate on which the plurality of fluid outlet elements are disposed. For example, jet disk openings can be provided in any desired number between ten and two hundred. If the fluid outlet elements have elastomeric ring membranes, it is advantageous to form the fluid outlet elements with the elastomeric ring membrane on the elastomeric plate. The one-piece design of elastomeric plate and fluid outlet elements can be advantageous both in manufacture and in assembly, since it permits a reduced number of component parts and simplified handling. The jet disk can have one or several one-piece elastomeric plates, on each of which a plurality of fluid outlet elements are formed. These one-piece elastomeric plates can differ, for example, in terms of the geometric form of the fluid outlet openings arranged therein, as a result of which the shower jet generating device has regions that are able to generate different shower jets.

Figure 2:
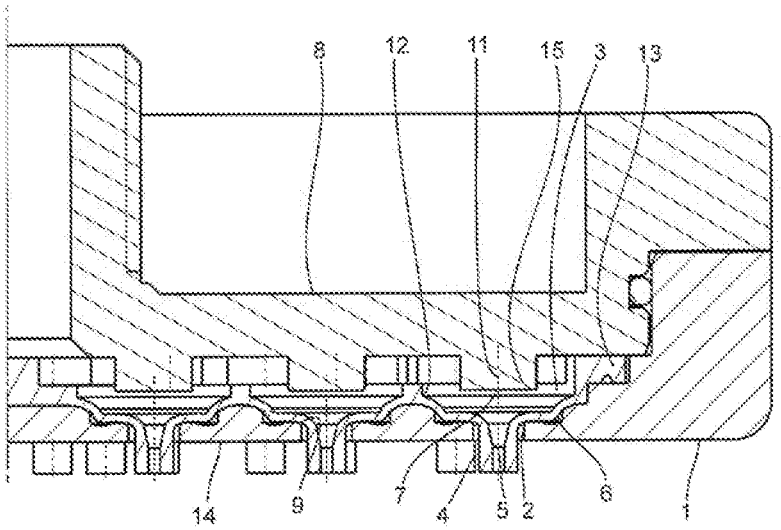
Figure 3:
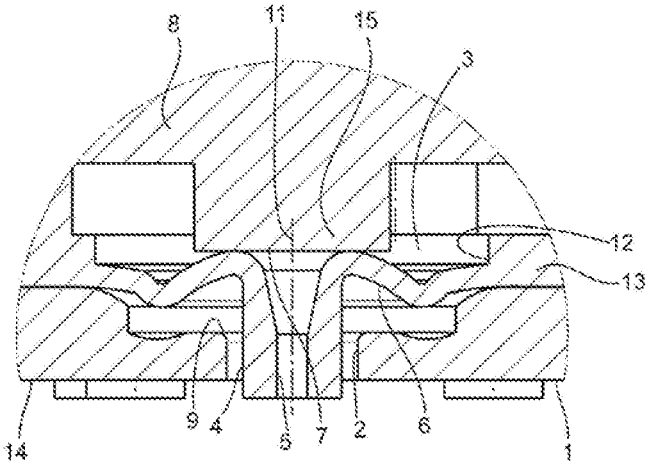
Figure 4:
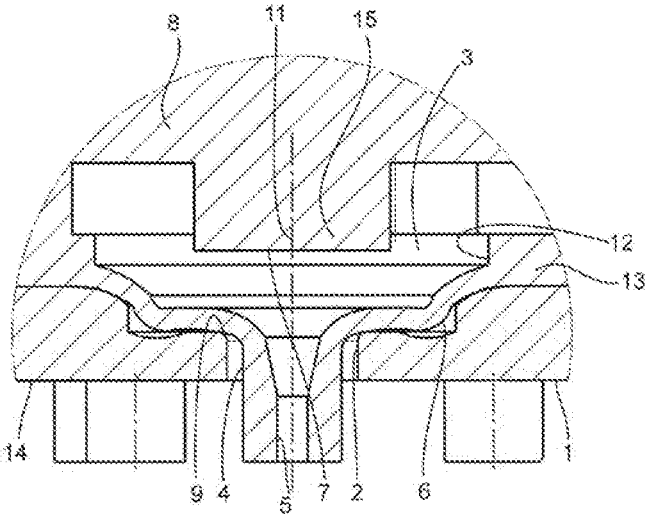
Figure 5:
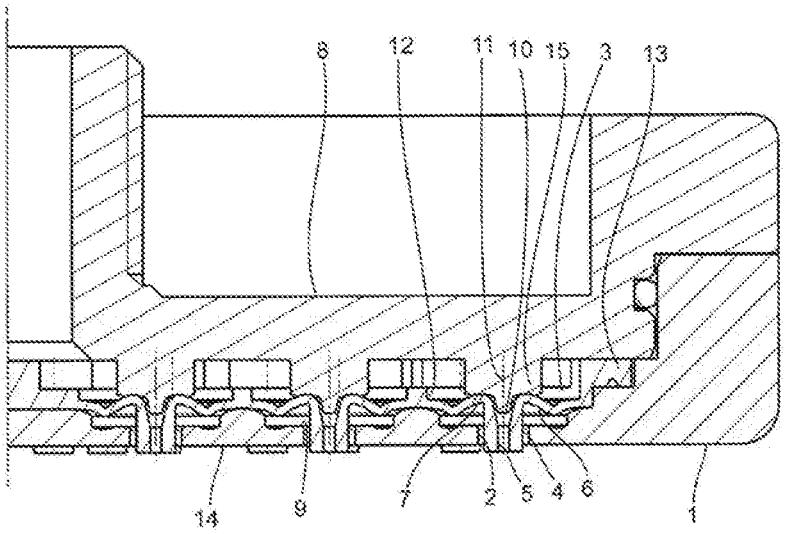
Figure 6:
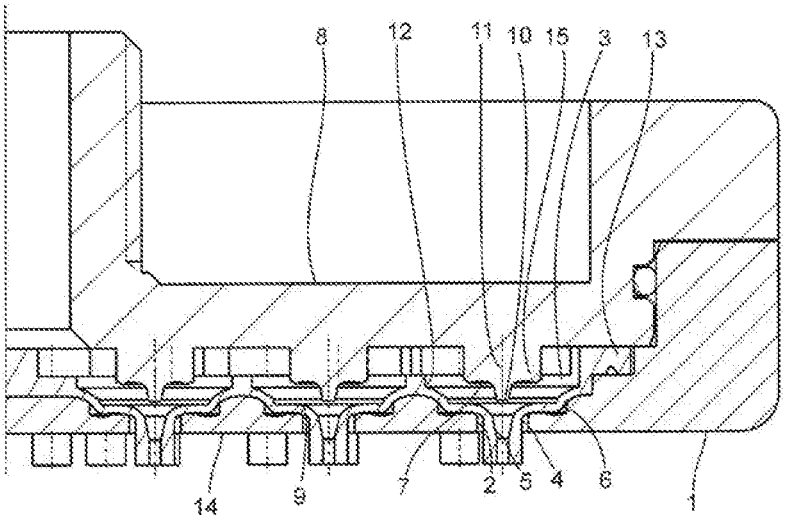
Figure 7:
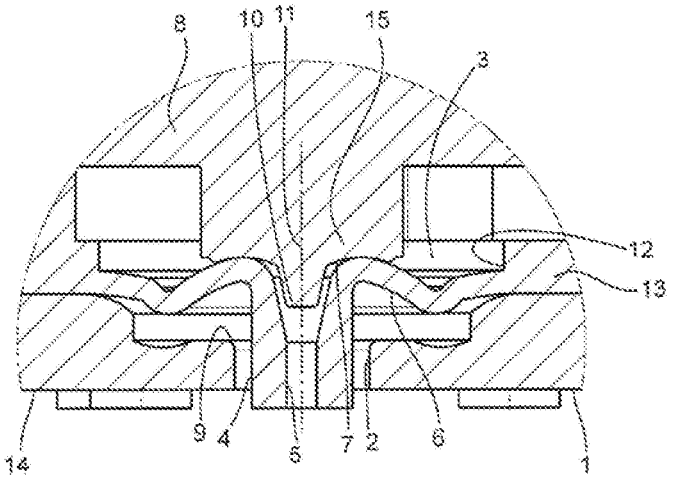
Figure 8:
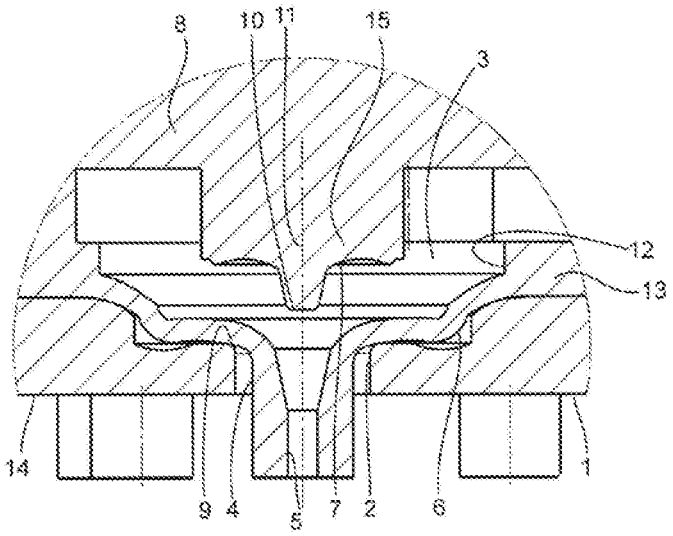

Advantageous embodiments of the invention are shown in the drawings and are explained in more detail below. In the drawings:

FIG. 1 shows a sectional view of a detail of a shower jet generating device with a plurality of fluid outlet elements in the blocking position and with plane valve seats, FIG. 2 shows the sectional view from FIG. 1 with the fluid outlet elements in the unblocking position, FIG. 3 shows a detailed view of an individual fluid outlet element from FIG. 1, FIG. 4 shows a detailed view of an individual fluid outlet element from FIG. 2, FIG. 5 shows a sectional view, corresponding to FIG. 1, of a variant with profiled valve seats, FIG. 6 shows a sectional view, corresponding to FIG. 2, of the variant from FIG. 5, FIG. 7 shows a detailed sectional view of an individual fluid outlet element from FIG. 5, and FIG. 8 shows a detailed view of an individual fluid outlet element from FIG. 6.

The shower jet generating device shown in FIGS. 1 to 4 is integrated in a sanitary shower head in order to generate a water shower jet whose jet shape is largely independent of the pressure of the supplied water. The water supplied to the shower head is introduced into a fluid chamber 3 which, on the outlet side, is delimited by a jet disk 1, in this example a multi-part jet disk 1, of the shower jet generating device. The jet disk 1 has a plurality of preferably between ten and two hundred, e.g. thirty, jet disk openings 2 through which the water can be conveyed from the fluid chamber 3 to the outside.

The multi-part jet disk 1 comprises an elastomeric plate 13, which can be made for example of a silicone material with a Shore hardness of preferably between fifty and seventy, e.g. sixty, and a metal plate 14, wherein the elastomeric plate 13 bears on the metal plate 14 from the fluid chamber side.

Furthermore, a housing plate 8 of the shower head is arranged lying opposite the jet disk 1 and delimiting the fluid chamber 3. The elastomeric plate 13 in this case is held with its outer edge region between the housing plate 8 and the metal plate 14 so as to seal the fluid chamber 3.

A plurality of elastomeric ring membranes 12 are formed on the one-piece elastomeric plate 13, each of them surrounding and supporting a movable fluid outlet element 4. The fluid outlet element 4 is thus connected to and held on the elastomeric plate 13 via the elastomeric ring membrane 12. Furthermore, the elastomeric plate 13 shown in FIGS. 1 to 4 is configured in one piece with the fluid outlet element 4 and with the elastomeric ring membrane 12. Moreover, the elastomeric plate 13 is placed onto the metal plate 14 in such a way that a movable fluid outlet element 4 is arranged at each jet disk opening 2.

The respective fluid outlet element 4 has a fluid outlet opening 5, which issues from the fluid chamber 3 and is in the form of an outlet nozzle. The fluid outlet opening 5 or the outlet nozzle has a frustoconical geometry on the inlet side, in the direction from the fluid chamber 3, which frustoconical geometry is adjoined on the outlet side by a circular cylindrical geometry serving as an end portion in which the fluid outlet opening 5 is narrowed to an outlet diameter which, for example, is typically in the range from 0.6 mm to 1.2 mm, in particular from 0.85 mm to 0.95 mm. For the intended use of the shower jet generating device, the fluid outlet opening 5 or outlet nozzle has a dimensionally stable geometry independent of fluid pressure. The axis of symmetry of the fluid outlet opening 5 is a nozzle longitudinal axis 11, which at the same time is an axial main direction component of the movement of the movable fluid outlet element 4. The nozzle longitudinal axis 11 also corresponds to a local surface normal of an exterior side of the jet disk 1 at the site in question.

Furthermore, the fluid outlet element 4 has a movable valve body 6 on which the fluid outlet opening 5 is arranged, wherein the movable valve body 6 is a rotationally symmetrical element in the manner of a cup spring. The movable valve body 6 is responsible for the movement of the fluid outlet element 4 and therefore also for the movement of the fluid outlet opening 5. As a result of the movement of the valve body 6, the fluid outlet element 4 is switched between a position unblocking the fluid outlet opening 5 and a position blocking the fluid outlet opening 5, wherein the movable valve body 6 cooperates with an unmovable valve seat 7. The cause of this movement is a fluid pressure that prevails in the fluid chamber 3 and that is generated by the supplied water. The fluid pressure acts on the movable valve body 6, and, as soon as a predefined limit pressure of between 0.2 bar and 0.35 bar, in particular between 0.24 bar and 0.26 bar, is exceeded in the fluid chamber, the valve body 6, and with it the fluid outlet element 4, is moved with an axial main direction component by way of the pressure from a blocking position to an unblocking position, in which the valve body 6 unblocks the fluid outlet opening 5. When the fluid pressure drops below the predefined limit pressure, the valve body 6 moves back automatically to its original position in which it blocks the fluid outlet opening 5.

FIG. 1 shows the blocking position of the movable valve body 6. In this position, the valve body 6 cooperates with the unmovable valve seat 7 such that the valve body 6 lies or presses against the valve seat 7, as a result of which the valve seat 7 blocks the fluid outlet opening 5 in a fluid-tight manner. On account of the movable valve body 6 lying tightly against the unmovable valve seat 7, no water can leave the fluid chamber 3 through the fluid outlet opening 5, and the shower head is thus made safe against dripping.

The unmovable valve seat 7 shown in FIGS. 1 to 4 is designed in one piece with the housing plate 8 of the shower head and has a plane seat surface against which the movable valve body 6 lies. To this end, the unmovable valve seat 7 is formed by a plateau-like projection 15 of the housing plate 8. The distance between the jet disk 1 and the housing plate 8 in this case is preferably at least 2 mm, not counting the plateau 15. This distance can be designated as the height of the fluid chamber 3.

It will also be seen from FIG. 1 that, in the blocking position of the movable valve body 6, the fluid outlet opening 5 extends through the jet disk opening 2 and, on the outlet side, has a projecting length in relation to the metal plate 14. This projecting length of the fluid outlet opening 5 can be, for example, in the range of 1 mm to 3 mm, e.g. approximately 2 mm. In the unblocking position of the movable valve body 6, which is shown in FIG. 2, the projecting length is preferably between 3 mm and 7 mm, e.g. approximately 5 mm. As a result of the movement of the valve body 6 controlled by the fluid pressure in the fluid chamber 3, the fluid outlet opening 5 thus executes a stroke movement with an axial stroke length of preferably 2 mm to 5 mm, e.g. approximately 3 mm.

In the example shown, the respective fluid outlet element 4 or its valve body 6 has a monostable configuration, i.e. a configuration such that the fluid outlet element 4 or its valve body 6 has precisely one stable position, which in the present case is given by the blocking position according to FIG. 1. When a fluid pressure prevails in the fluid chamber, the fluid outlet element 4 or its valve body 6 is moved forward from this position, by the stroke length, to the unblocking position according to FIG. 2 when and as soon as the fluid pressure exceeds an associated limit pressure value of, for example, 0.25 bar to 0.35 bar. In the unblocking position, the valve body 6 no longer lies against the unmovable valve seat 7, and the water is able to leave the fluid chamber 3 by way of the respective fluid outlet opening 5 in order to form the desired shower jet. When the fluid pressure drops below the limit value again or decreases to zero, for example when the supply of water is turned off, the fluid outlet element 4 or its valve body 6 returns automatically to the blocking position under the effect of an elastic restoring force, such that water is reliably prevented from dripping from the fluid outlet opening 5.

FIGS. 3 and 4 show enlarged details of one of the fluid outlet elements 4, and of its environment, in the blocking position and the unblocking position, respectively. As will be seen more clearly from these figures, the jet disk opening 2, on which the depicted fluid outlet opening 4 is arranged, is designed in this example as a countersunk bore in the metal plate 14, wherein the countersink has a geometry, in particular a valve abutment surface 9, which supports the movable valve body 6 in the unblocking position and limits its movement. So as not to damage the movable valve body 6, the countersink of the countersunk bore is preferably shaped in such a way that it has no sharp angles.

FIGS. 5 to 8 show a variant of the shower jet generating device from FIGS. 1 to 4, wherein, to give a better understanding, like reference signs have been used for identical and functionally equivalent elements and, in this respect, reference can also be made to what has been said above in relation to the exemplary embodiment of FIGS. 1 to 4, in which case it is essentially only the differences that will be discussed hereinbelow. In this case, the differences lie specifically in the design of the unmovable valve seat 7.

In the variant in FIGS. 5 to 8, the unmovable valve seat 7 has a valve seat projection 10 which protrudes into the fluid outlet opening 5 when the fluid outlet opening 5 is blocked and does not protrude into the fluid outlet opening 5 when the fluid outlet opening 5 is unblocked. It is thus possible to counteract lime deposits at the fluid outlet opening 5, since these deposits are detached from the fluid outlet opening 5 by the valve seat projection 10 as the fluid outlet element 4 moves between the unblocking position and the blocking position.

Moreover, the unmovable valve seat 7 in the variant in FIGS. 5 to 8 has a configuration that is adapted in shape to that of the movable valve body 6. For this purpose, the unmovable valve seat 7 has an annular depression or recess in the form of a negative configuration of the movable valve body 6 lying on it in the blocking position. This increases the contact surface between the movable valve body 6 and the unmovable valve seat 7 in the blocking position, compared to the plane seat surface in the variant in FIGS. 1 to 4, and contributes to a centring of the position of the valve body 6 pressing against the valve seat 7 in the blocking position.

This increased contact surface and the centred position of the valve body 6 advantageously support the secure sealing of the fluid outlet opening 5.

In a variant of the shower jet generating device that is in accordance with the invention but is not shown, the unmovable valve seat 7 is designed in the form of a preferably frustoconical stopper which closes the fluid outlet opening 5 in the blocking position. The stopper-shaped unmovable valve seat 7 in this case protrudes into the fluid outlet opening 5.

In a variant of the shower jet generating device that is in accordance with the invention but is not shown, a partition plate, instead of the depicted housing plate 8, has the unmovable valve seat. This partition plate is preferably integrated in a shower head and has the effect of delimiting the fluid chamber on the side thereof lying opposite the jet disk.

As is made clear by the exemplary embodiments shown and explained above, the invention makes available a shower jet generating device which reliably prevents undesired dripping and which is relatively easy to produce and operationally reliable. Furthermore, the outlet cross section of the fluid outlet opening is largely uninfluenced by the fluid pressure in the fluid chamber. The invention can be used in particular in sanitary engineering, but also in other applications in which there is a need to be able to generate a shower jet that is operationally reliable and does not cause drips.

What is claimed is:

1. A shower jet generating device for a sanitary shower head, comprising:

a jet disk including a plate, and a plurality of jet disk openings within the plate and out of which each of the plurality of jet disk openings a fluid is emitted in an axial direction perpendicular to the plate to form a shower jet, and delimiting a fluid chamber on an outlet side, each of the plurality of jet disk openings downstream from the fluid chamber and defining an outlet opening in direct communication with an outside environment a fluid outlet element disposed on each of the plurality of jet disk openings and movable in an axial main direction component independent of other ones of the fluid outlet elements, which fluid outlet element includes a movable valve body having a fluid outlet opening issuing from the fluid chamber, which fluid outlet opening is unblocked in an unblocking position of the fluid outlet element and is blocked in a blocking position of the fluid outlet element in response to a fluid pressure in the fluid chamber the fluid outlet opening has a dimensionally stable open shape independent of fluid pressure within the fluid chamber;

wherein the movable valve body cooperates with an unmovable valve seat, which unblocks the fluid outlet opening in the unblocking position of the fluid outlet element and blocks it in the blocking position of the fluid outlet element;

wherein in the blocking position, the movable valve body of the fluid outlet element abuts against the unmovable valve seat, upstream from the fluid outlet opening, when no fluid pressure is present in the fluid chamber; and wherein the valve body in the blocking position is downstream of the fluid chamber.

2. The shower jet generating device according to claim 1, wherein the fluid chamber is delimited by one of a partition plate and a housing plate including the unmovable valve seat, wherein said one of the partition plate and housing plate is arranged opposite to the jet disk.

3. The shower jet generating device according to claim 1, wherein the movable valve body abuts on a valve abutment surface of the jet disk in the unblocking position of the fluid outlet element.

4. The shower jet generating device according to claim 1, wherein the fluid outlet element with its fluid outlet opening in at least one of its unblocking position and in its blocking position extends through the jet disk opening.

5. The shower jet generating device according to claim 1, wherein the valve seat has a valve seat projection which protrudes into the fluid outlet opening when the fluid outlet opening is blocked.

6. The shower jet generating device according to claim 1, wherein the fluid outlet opening is provided by an outlet nozzle with a nozzle longitudinal axis extending in parallel to a local surface normal to an exterior side of the jet disk.

7. The shower jet generating device according to claim 1, wherein the fluid outlet element includes an elastomeric ring membrane surrounding and supporting the movable valve body.

8. The shower jet generating device according to claim 1, wherein the fluid outlet element has a one-piece design.

9. The shower jet generating device according to claim 1, wherein a plurality of jet disk openings and associated fluid outlet elements is provided, and the jet disk includes a one-piece elastomeric plate on which the plurality of fluid outlet elements are disposed.

10. The shower jet generating device according to claim 1, wherein the fluid outlet opening has at least one of a circular cylindrical geometry and a conical geometry, independent of fluid pressure.

11. The shower jet generating device according to claim 1, wherein the fluid outlet element is movable in the axial direction within the at least one jet disk opening.

12. The shower jet generating device according to claim 1, wherein the fluid chamber is defined intermediate the housing plate at an upstream end and the jet disk at a downstream end.

13. The shower jet generating device according to claim 7, wherein a plurality of the elastomeric ring membranes are formed on the elastomeric plate, each of the elastomeric ring membranes are arranged at one of the at least one jet disk openings.

* * * * *